US005360363A

United States Patent [19]

Levin

[11] Patent Number: 5,360,363

[45] Date of Patent: Nov. 1, 1994

[54] FLYING DISK WITH ROTATABLE MEMBER

[76] Inventor: John M. Levin, 412 Fairview Rd., Narberth, Pa. 19072

[21] Appl. No.: 159,067

[22] Filed: Nov. 29, 1993

[51] Int. Cl.[5] ..... A63H 27/00; A63H 1/00

[52] U.S. Cl. ..... 446/46; 446/236

[58] Field of Search ..... 446/27, 46, 47, 48, 446/233, 234, 235, 236, 243, 244, 57, 56; 273/424, 128 A

[56] References Cited

U.S. PATENT DOCUMENTS

| | | | |
|---|---|---|---|
| 2,776,523 | 1/1957 | Higley | 446/243 |
| 2,822,176 | 2/1958 | Robes . | |
| 3,082,572 | 3/1963 | Knox, Jr. . | |
| 3,374,763 | 3/1968 | Browning | 446/243 X |
| 3,502,335 | 3/1970 | Sholin . | |
| 3,603,033 | 9/1971 | Mueller | 446/57 |
| 3,852,910 | 12/1974 | Everett . | |
| 3,900,987 | 8/1975 | Holt . | |
| 3,948,523 | 4/1976 | Michael . | |
| 4,112,612 | 9/1978 | Woods . | |
| 4,132,029 | 1/1979 | Thompson et al. . | |
| 4,203,249 | 5/1980 | Böhm | 446/48 |
| 4,248,010 | 2/1981 | Fox | 446/47 |
| 4,262,911 | 4/1981 | Opresik et al. | 446/46 X |
| 4,381,620 | 5/1983 | Panzarella | 446/236 X |
| 4,516,946 | 5/1985 | Rodarte | 446/46 |
| 4,846,749 | 7/1989 | Petko | 446/47 X |
| 5,045,011 | 9/1991 | Lovik | 446/46 |
| 5,055,080 | 10/1991 | Cwalinski et al. | 446/46 |
| 5,123,869 | 6/1992 | Schipmann | 446/46 |
| 5,297,799 | 3/1994 | Slater et al. | 273/424 X |

FOREIGN PATENT DOCUMENTS

| | | | |
|---|---|---|---|
| 3023762 | 1/1982 | Germany | 273/128 A |

*Primary Examiner*—Robert A. Hafer
*Assistant Examiner*—D. Neal Muir
*Attorney, Agent, or Firm*—Caesar, Rivise, Bernstein, Cohen & Pokotilow, Ltd.

[57] ABSTRACT

A flying disk which has a decorative member rotatably mounted in the top surface thereof and which is free to rotate relative to rotation of the flying disk as the flying disk is spins through the air about a central axis. In one embodiment, a hollow spherical member is mounted in a hole at the center of the flying disk member and is free to rotate about an axis which is parallel to the plane of the upper wall of the disk. Another embodiment mounts the spherical member so that it is free to rotate about the central axis of the flying disk. In another embodiment, the rotating member is a double truncated cone shape. The rotating members can have a smooth exterior surface or may have vanes projecting therefrom and/or openings, e.g., elongated slits or circular holes, therein, to impart spin to the rotating members during flight of the flying disk.

18 Claims, 3 Drawing Sheets

FLYING DISK WITH ROTATABLE MEMBER

BACKGROUND OF THE INVENTION

This invention relates generally to throwing devices or flying disks and more specifically to a flying disk which comprises a generally flat disc member on which a rotating member is mounted.

Throwing toys such as flying disks sold under the Registered Trademark FRISBEE by Whamo Manufacturing Company have become extremely popular in recent years. As is known, such devices basically comprise round, disk-like, upper portion having downwardly depending peripheral skirt or lip to define a generally hollow interior space. The device is formed of any suitable material, e.g., a thin plastic, and is arranged to be thrown with a spinning motion while the hollow interior is facing somewhat downward to trap air thereunder, so that the disk spins about its central axis and is able to fly over long distances while being supported by the air thereunder. Depending upon the type of throwing motion imparted to the disk, its aerodynamic qualities enable the disk to rise and soar and to take various paths or trajectories. In some uses the disk is thrown to another person or a pet, e.g., a dog, for that person or pet to catch it before it hits the ground. Thus, fun, sport, and exercise are provided to both the thrower and the catcher. Team games have been developed utilizing the flying disk. In particular, in recent years, organized competitions have become very popular wherein competitive teams vie to attempt to throw and run with a flying disk down the field toward a goal.

Various types of flying disks are disclosed in the patent literature. For example, U.S. Pat. No. 3,502,335 (Sholin) discloses a dome-shaped flying disk with grooves and balls which spin in the grooves when the flying disk is thrown. U.S. Pat. No. 4,132,029 (Thompson et al.) discloses a flying disk with a pyramid-shaped member mounted at the center of the disk. U.S. Pat. No. 4,112,612 (Woods) discloses a flying disk with an open central area in which different shaped members may be mounted.

Flying disks which use blades, vanes or foils to effect the aerodynamics of the flying disk are disclosed in the following U.S. Pat. Nos.: 3,082,572 (Knox, Jr.); 2,822,176 (Robes); and 3,852,910 (Everett). U.S. Pat. Nos. 3,948,523 (Michael) and 4,248,010 (Fox) disclose flying disks which have lights mounted thereon, and U.S. Pat. No. 3,900,987 (Holt) discloses a flying disk with whistles mounted on its outer circumference. U.S. Pat. No. 4,846,749 (Petko) discloses a flying disk with a shaft removably mounted in the top surface of the flying disk upon which a propeller rotates.

However, none of the patents disclose a flying disk which include a rotatable member mounted in a hole in the center of the upper portion and which can rotate freely relative to the rotation or spin of the flying disk itself, thereby providing an enhanced appearance, while also providing stabilizing gyroscopic effect to alter the aerodynamic characteristics of the flying disk.

OBJECTS OF THE INVENTION

Accordingly, it is the general object of the instant invention to provide a flying disk which addresses the aforementioned needs.

It is a further object of this invention to provide a flying disk with aerodynamic characteristics which are different than prior art flying disks.

It is a further object of the instant invention to provide a flying disk upon which is rotatably mounted a member to rotate relative to the spin or rotation of the flying disk as the flying disk spins through the air.

It is a further object of the instant invention to provide a flying disk upon which is rotatably mounted a member to rotate in a controlled, rotary path.

It is still a further object of the instant invention to provide a flying disk upon which is member is rotatably mounted so that it can rotate about an axis which is parallel to the plane of the flying disk as the flying disk spins through the air.

It is still a further object of the instant invention to provide a flying disk upon which is member is rotatably mounted so that it can rotate about an axis which is perpendicular to the plane of the flying disk as the flying disk spins through the air.

SUMMARY OF THE INVENTION

These and other objects of the instant invention are achieved by providing a flying disk device comprising a disk-like upper wall portion having a circular periphery in the form of a downwardly depending skirt. The skirt extends about a central axis extending through the center of the disk-like upper wall portion.

The upper wall and the peripheral skirt have an outer surface and an inner surface, with the inner surface being hollow to trap air therein when the flying disk is thrown with its undersurface directed somewhat downward. This action causes the flying disk to spin about the central axis.

The upper wall of the flying disk device has a central opening and a rotatable member located within the opening. The rotatable member is supported in the opening by mounting means to enable it to spin about a first axis while said flying disk spins through the air.

In one embodiment the first axis is coincident with the central axis of the flying disk device. In another embodiment it perpendicular to the central axis.

In some embodiments the rotatable member comprises a hollow sphere, while in another embodiment the rotatable member comprises a dual truncated cone. The spheres or dual truncated cone may include plural opening, e.g., elongated slits or circular openings, either with our without air-intercepting vanes associated therewith.

DESCRIPTION OF THE DRAWING

Other objects and many of the intended advantages of this invention will be readily appreciated when the same becomes better understood by reference to the following detailed description when considered in connection with the accompanying drawings, wherein.

DETAILED DESCRIPTION OF THE PREFERRED EMBODIMENTS

Figure 1:
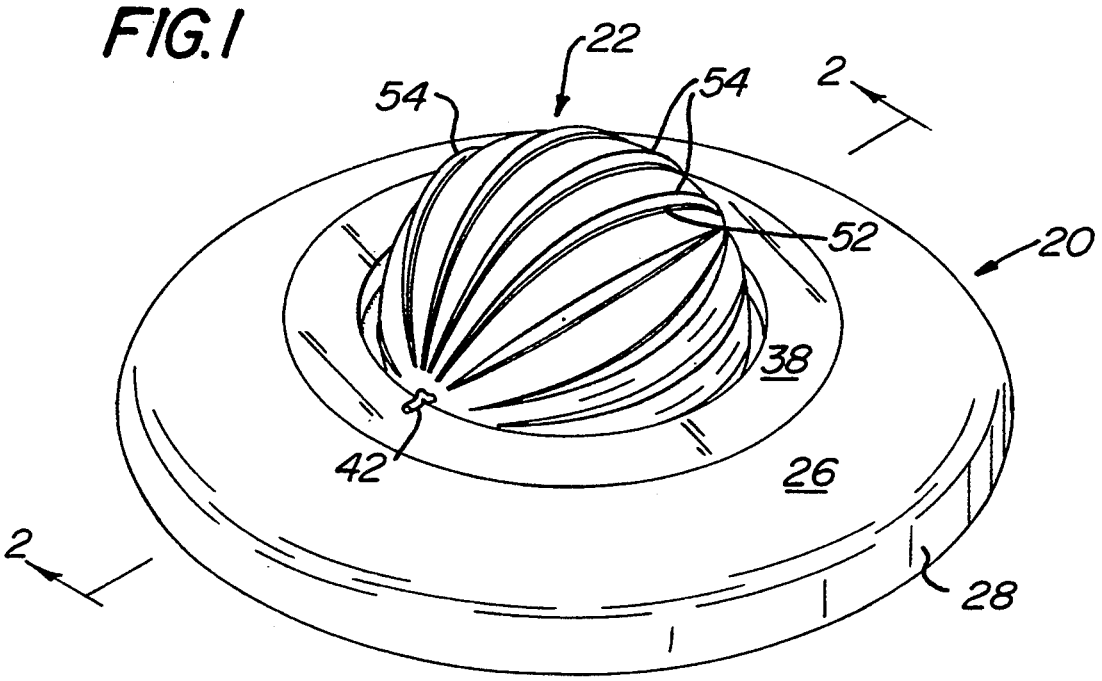
FIG. 1 is an isometric view of one embodiment of a flying disk constructed in accordance with this invention.

Referring now in greater detail to the various figures of the drawing, wherein like reference characters refer to like parts, there is shown in FIG. 1 an isometric view of one embodiment of a flying disk 20 of the present invention. The flying disk 20 is generally constructed like prior art FRISBEE® flying disks except for the central portion thereof. To that end, as will be described in detail later the central portion of the disk 20 includes a rotatable member 22 which is arranged to rotate about an axis which is either parallel to the central axis 24 about which the flying disk itself spins in flight or about an axis perpendicular to the central axis.

Figure 2:
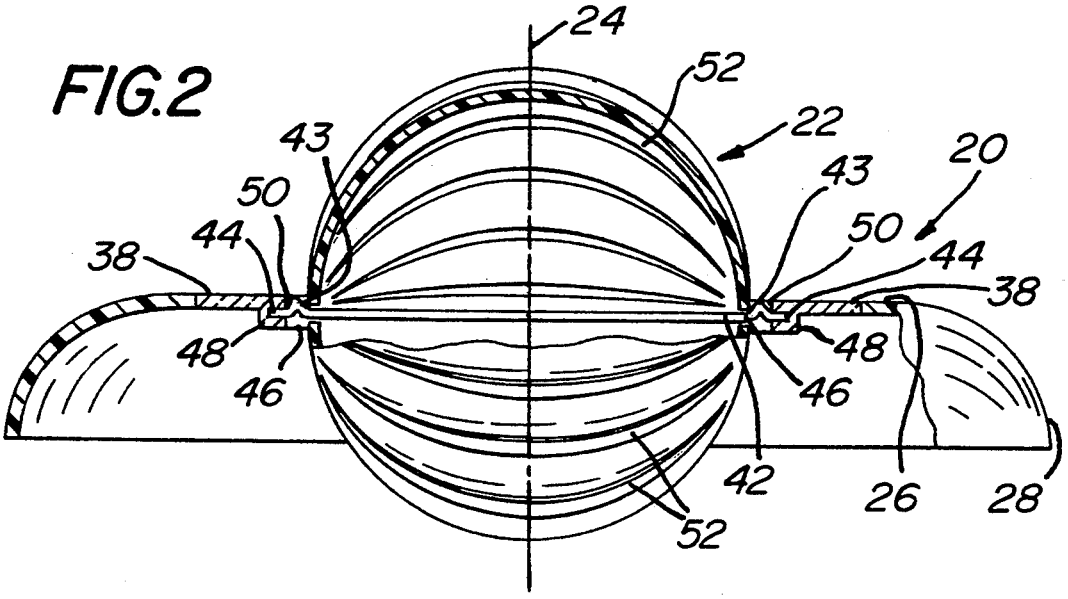
FIG. 2 is an enlarged partial sectional view, taken along the line 2—2 of FIG. 1.

Before describing the rotatable member 22 and its support structure a brief description of the remainder of the flying disk is in order. To that end, as can be seen in FIGS. 1 and 2 the flying disk 20 includes a generally planar central walled portion 26 which terminates in a downwardly curved skirt or rim 28 whose periphery is circular and extends concentrically about the central axis 24. The disk is arranged to spin around its central axis when it is thrown in a conventional manner, like a FRISBEE® flying disk.

The wall portion and rim of the flying disk 20 can be formed as an integral unit, e.g., molded, of any suitable material, e.g., thin sheet of any suitable plastic. The outer surface of the flying disk is designated by the reference numeral 30 (FIG. 2), while its inner, or under, surface is designated by the reference numeral 32 (FIG. 2). The under surface 32 defines a somewhat hollow interior space 34 for trapping air therein when the flying disk is thrown in a conventional manner, i.e., thrown so that its undersurface is directed downward and so it is spinning about its central axis 24.

A central opening 36 is provided in the top wall centered on the central axis 24. A mounting section 38 of circular profile is disposed within the central opening 36 and is secured in place buy any suitable means, e.g., an adhesive. Alternatively, the mounting section 38 may be integrally molded with the remainder of the disk. The mounting section itself includes a central opening 40 which is of circular profile and centered about the central axis 24 of the flying disk.

The mounting section serves as one portion of means for rotatably supporting the rotatable member 22 on the flying disk 20. In the embodiment shown in FIGS. 1 and 2 the rotatable member comprises a hollow sphere which is arranged to rotate about an axis lying in a plane immediately adjacent the undersurface 32 and perpendicular to the central axis 24. The sphere is rotatably mounted on an elongated linear axle or spindle 42 which extends diametrically through the sphere. The spindle 42 is formed of any suitable material, e.g., a metal, and includes a pair of ends 44 that extend out of respective diametrically located holes 46 in the sphere 22 and are arranged to be supported in respective portions of the mounting section 38. In particular, as can be seen clearly in FIG. 2 the mounting section includes a pair of projections or tabs 48 projecting downward slightly from the underside of the mounting section and disposed diametrically opposite to each other. Each tab includes a bore 50 to tightly receive the spindle 42 therein, in a manner which precludes rotation of the spindle. If desired or required the spindle can actually be bonded into the bore. When so mounted the sphere is arranged to rotate about the axis of the spindle. In the preferred form of the invention the spindle 42 also includes axially spaced-apart ears 43 formed thereon to center the sphere for rotation on the axle, and to preclude undesired lateral shifting of the sphere relative to the mounting opening in the mounting section 38.

The sphere 22 is formed of any suitable material, e.g., plastic, and includes a plurality of openings 52 which are formed therein, such as by being molded therein. Each of the openings 52 is oriented so that it extends longitudinally along approximately one half the periphery of the sphere from its two pole holes 46, i.e., the points at which the ends of the spindle extend therethrough and into to bores 50. One edge of each of the openings is in the form of an upstanding rib 54 extending along the length of the opening. The ribs act as vanes so that when the flying disk is in flight and spinning about its central axis 24 the vanes causes the sphere to rotate about the axis of its spindle. Thus, when the flying disk is thrown in a conventional manner, the sphere 22 rotates about a horizontal axis while the flying disk rotates about its central axis 24 when it is in normal flight.

In accordance with a preferred embodiment of this invention the material, e.g., plastic, making up the mounting section 38 is transparent or translucent so that one can see through it, while the material making up the top wall 26, the skirt 28, and the sphere is opaque. The various components, except for the mounting section may be of the same or different colors to cause the flying disk to simulate various things. For example the sphere can be colored to simulate the features of the planet Saturn, while the top wall and skirt can be colored to simulate Saturn's rings. Since the mounting section is transparent the rings will appear spaced away from the sphere, i.e., Saturn.

Figure 3:
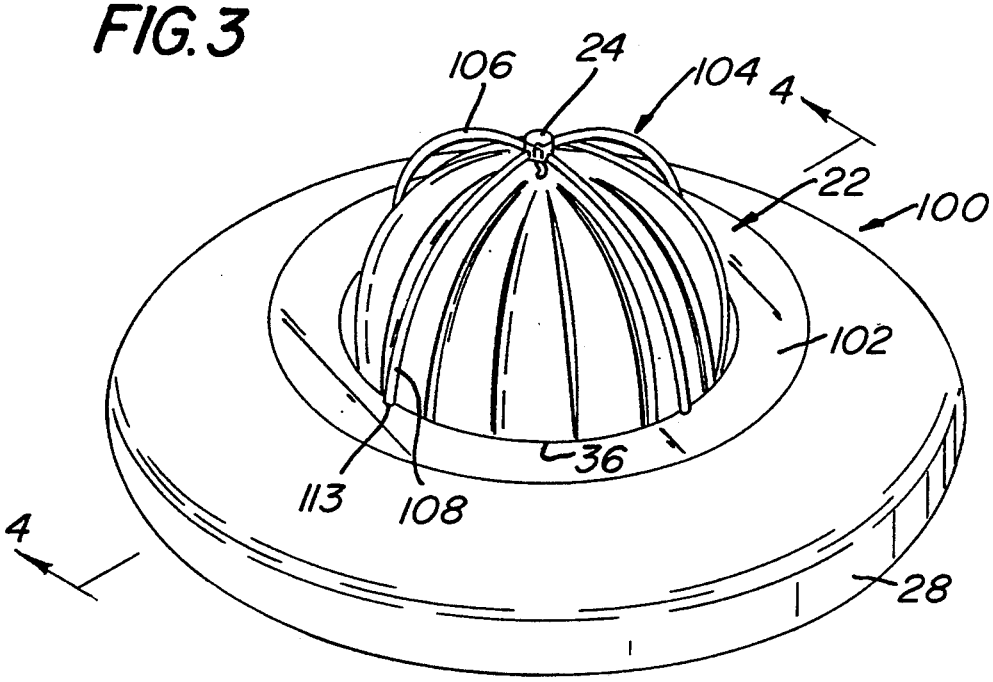
FIG. 3 is an isometric view of another embodiment of a flying disk constructed in accordance with this invention.
Figure 4:
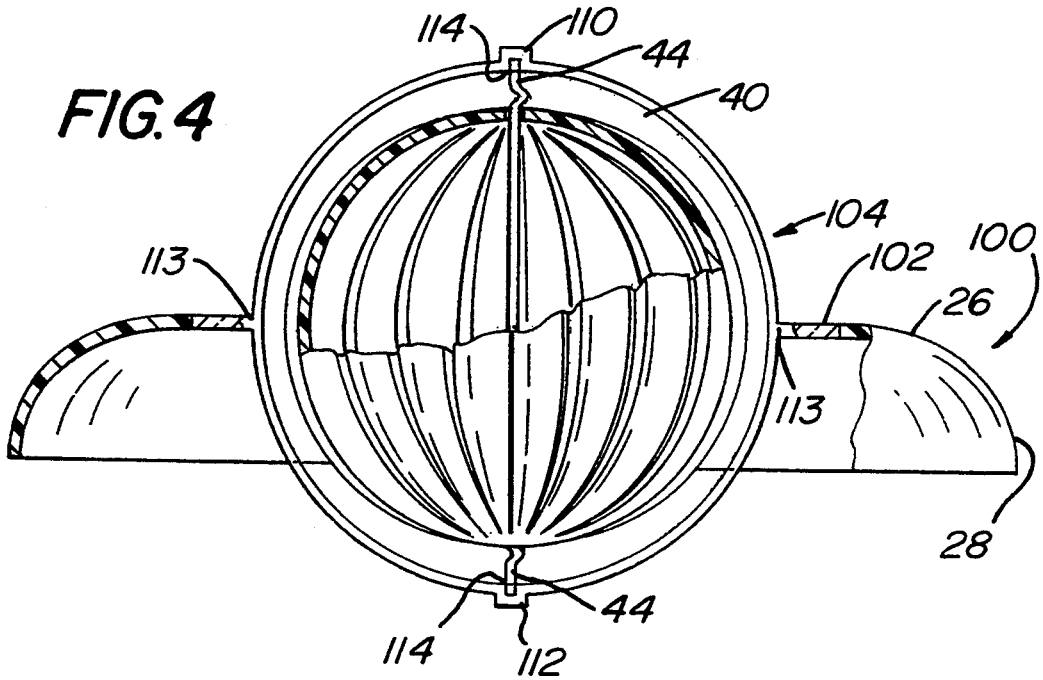
FIG. 4 is an enlarged partial sectional view, taken along the line 4—4 of FIG. 2.

In FIGS. 3 and 4 there is shown an alternative embodiment 100 of a flying disk constructed in accordance with this invention. In the embodiment 100 the sphere 22 is mounted so that it rotates about the central axis 24. The flying disk 100 is identical in all respects to the flying disk 20, except for the means for mounting the sphere 22. Thus, in the interests of brevity all common structural and operational features of the flying disk 100 will be given the same reference numerals as those components of the flying disk 20 and will not be described again.

The means for mounting the sphere 22 for rotation about the central axis 24 basically comprises a mounting section 102, which is similar in construction to the section 38 except that the section 102 includes a mounting frame 104 secured thereto, preferably by being integrally molded therewith. The section 102 either is fixedly secured within the opening 36 in the wall portion 26 of the flying disk 100 or is integrally molded with the wall portion, in the same manner as described heretofore with reference to the flying disk 20. The section 102 includes a central opening 40 in which the sphere 22 is located. The mounting frame 104 includes two mounting rings 106 and 108 which are disposed perpendicularly to each other and are secured together at their poles 110 and 112. The rings 106 and 108 are secured 9 (e.g., molded) to the mounting section at points 113 corresponding to their equator. Each of the poles 110 and 112 includes a bore 114 therein for receipt of a respective end 44 of the spindle 42. Accordingly, with the spindle extending through the sphere and so that its ends 44 are located within the bores 114 in the frame 104, the sphere 22 will rotate about the axis formed by the spindle (which is coincident with the central axis 24) when the flying disk is in flight and spinning about that axis due to action of the vanes as described heretofore.

The mounting frame 104 and the mounting section 102 are preferably formed as an integral unit of any suitable transparent or translucent material so that the sphere will appear to be free floating in the flying disk. Moreover portions of the disk and the sphere may be colored, e.g., painted, to simulate the planet Saturn and its rings. Moreover, as stated earlier, the mounting frame 104 and mounting section 102, in addition to be formed as an integral unit, also can be integrally formed as part of the remaining disk structure.

Figure 5:
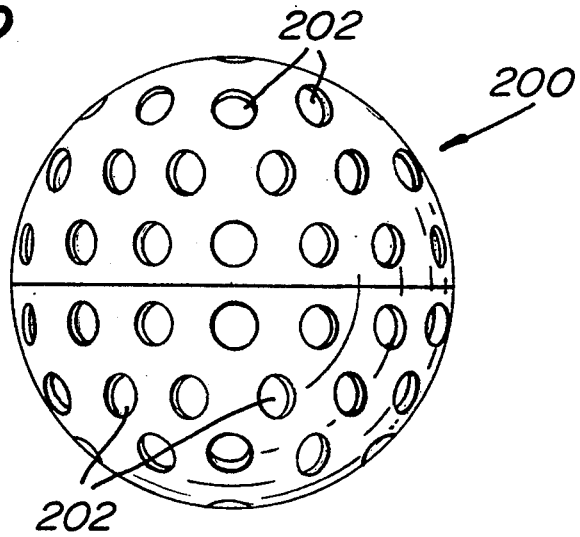
FIG. 5 is a side elevational view of a component which can be used in either of the embodiments of the flying disks shown in FIGS. 1 and 3.

In FIG. 5 there is shown an alternative spherical member 200 which can be used in lieu of the sphere 20 described heretofore. The spherical member 200 is a thin hollow sphere having a plurality of circular holes 202 therein. These holes create a turbulent air flow like that produced by a "whiffle ball" type of toy. Accordingly, when a flying disk utilizing a sphere 200 as it rotatable member is thrown in a normal manner the spin of the disk about its central axis will create a turbulent airflow through the holes 202 in the sphere 200, thereby imparting rotary motion to the sphere.

Figure 6:
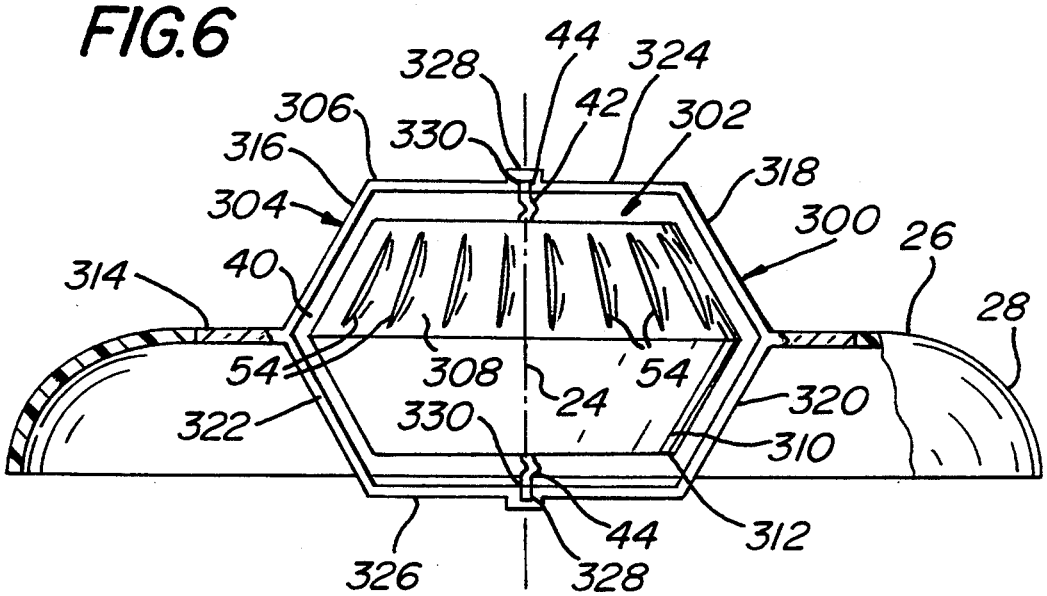
FIG. 6 is an enlarged partial sectional view, similar to that of FIGS. 2 and 4, but showing yet another alternative embodiment of a flying disk constructed in accordance with this invention.

A third embodiment of a flying disk in accordance with this invention is shown at 300 in FIG. 6. In this embodiment, the rotating component 302 is not spherical, but instead is shaped to simulate the cabin of a spaceship, flying saucer or UFO. The flying disk 300 is identical in all respects to the flying disk 200, except for the shape of rotating member 302 and the construction of the frame 304 for mounting the member 302 for rotation. Thus, in the interests of brevity all common structural and operational features of the flying disk 300 will be given the same reference numerals as those components of the flying disk 200 and will not be described again.

As can be seen in FIG. 6 the rotatable member 302 is a double truncated cone having a planar top surface 306, a conical upper surface 308, a conical lower surface 310, and a planar bottom surface 312. The conical upper surface includes a plurality of slits 52 therein, each of which includes an upstanding ridge along an edge thereof. A hole (not shown) is provided in the center of the top surface 306 and a similar hole is provided in the bottom surface 312 of the rotatable member 302. The spindle extends through the interior of the member 302 so that its ends 44 extend out of the holes in the top and bottom surface to rotatably mount the member 302 in the frame 304.

The frame 304 comprises a portion of a mounting section 314. The mounting section 314 is constructed similarly to the sections 38 and 102 and is secured to the wall 26 of the flying disk 300 in the same manner as described heretofore. The frame 304 includes four elongated linear struts 316, 318, 320, and 322, and two elongated bridging beams 324 and 326. The strut 316 is connected to and extends upward at an acute angle to the mounting section 314 from a point immediately adjacent the central opening 40 therein. The strut 318 is connected to and extends upward at an acute angle to the mounting section from a point immediately adjacent the central opening 40 diametrically opposed to the strut 316. The upper ends of the struts 316 and 318 are connected together by the bridging beam 324. In a similar manner the strut 322 is connected to and extends downward at an acute angle to the mounting section from the strut 316, and the strut 320 is connected to and extends downward at an acute angle to the mounting section from the strut 318. The lower ends of the struts 320 and 322 are connected together by the bridging beam 326.

A projection 328 having a bore 330 therein is located at the middle of the bridging strut 324, and a similar projection with a bore therein is located at the middle of the bridging strut 326. The bores 330 are aligned on the central axis 24 of the flying disk 300, and each bore is adapted to receive a respective end 44 of the spindle 42, to thereby rotatably mount the member 302 within the frame. When so mounted the member 302 is free to rotate about the axis of the spindle. Thus, when the flying disk is thrown in the normal manner the ribs 54 of the member 302 act as vanes to cause the member 302 to rotate about the axis of its spindle, i.e., the central axis 24.

In accordance with one aspect of this invention portions of the flying disk 300 are preferably metallic colored or painted to simulate a flying saucer or other UFO.

Without further elaboration, the foregoing will so fully illustrate my invention that others may, by applying current or future knowledge, readily adapt the same for use under various conditions of service.

I claim:

1. A flying disk device comprising a disk-like upper wall portion having a circular periphery in the form of a downwardly depending skirt, said skirt extending about a central axis which extends through the center of said disk-like upper wall portion, said upper wall and said skirt having an outer surface and an inner surface, said inner surface enclosing a hollow area to trap air therein when said flying disk is thrown with its undersurface directed somewhat downward while said disk is caused to spin about said axis, said upper wall having a central opening extending entirely through said upper wall and a rotatable member located within said opening, said member extending above said upper wall and below said upper wall into said hollow area and supported in said opening by mounting means to enable said rotatable member to spin about a chosen axis while said flying disk spins through the air.

2. The flying disk of claim 1 wherein said mounting means comprises a frame and an elongated spindle extending through said rotatable member along said first axis, said spindle being mounted in said frame and oriented to extend perpendicularly to said central axis.

3. The flying disk of claim 1 wherein said mounting means comprises a frame and an elongated spindle extending through said rotatable member along said first axis, said spindle being mounted in said frame and oriented to extend coincident with said central axis.

4. The flying disk of claim 2 wherein said rotatable member comprises plural vanes thereon.

5. The flying disk of claim 2 wherein said rotatable member comprises plural openings therein.

6. The flying disk of claim 4 wherein said rotatable member comprises plural openings therein.

7. The flying disk of claim 2 wherein said rotatable member comprises a sphere.

8. The flying disk of claim 5 wherein said rotatable member comprises a sphere.

9. The flying disk of claim 1 wherein said mounting means comprises a transparent mounting section supporting said frame, and wherein said frame is transparent.

10. The flying disk of claim 1 wherein said rotatable member provides a decorative appearance.

11. The flying disk of claim 3 wherein said rotatable member comprises plural vanes thereon.

12. The flying disk of claim 3 wherein said rotatable member comprises plural openings therein.

13. The flying disk of claim 3 wherein said rotatable member comprises a sphere.

14. The flying disk of claim 12 wherein said rotatable member comprises a sphere.

15. The flying disk of claim 2 wherein said mounting means comprises a transparent mounting section supporting said frame, and wherein said frame is transparent.

16. The flying disk of claim 3 wherein said mounting means comprises a transparent mounting section supporting said frame, and wherein said frame is transparent.

17. The flying disk of claim 2 wherein said rotatable member provides a decorative appearance.

18. The flying disk of claim 3 wherein said rotatable member provides a decorative appearance.

* * * * *